US010890375B2

(12) United States Patent
Chambron et al.

(10) Patent No.: US 10,890,375 B2
(45) Date of Patent: Jan. 12, 2021

(54) METHOD FOR LIQUEFYING NATURAL GAS AND NITROGEN

(71) Applicant: L'Air Liquide, Société Anonyme pour l'Etude et l'Exploitation des Procédés Georges Claude, Paris (FR)

(72) Inventors: Nicolas Chambron, Saint Maur des Fosses (FR); Richard Dubettier-Grenier, La Varenne Saint Hilaire (FR); Loic Joly, Paris (FR); Vianney Meunier, Paris (FR); Christophe Szamlewski, Combs la Ville (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 135 days.

(21) Appl. No.: 16/060,077

(22) PCT Filed: Nov. 8, 2016

(86) PCT No.: PCT/FR2016/052888
§ 371 (c)(1),
(2) Date: Jun. 7, 2018

(87) PCT Pub. No.: WO2017/098099
PCT Pub. Date: Jun. 15, 2017

(65) Prior Publication Data

US 2018/0372404 A1 Dec. 27, 2018

(30) Foreign Application Priority Data

Dec. 7, 2015 (FR) ..... 15 61923

(51) Int. Cl.
*F25J 1/02* (2006.01)
*F25J 3/04* (2006.01)
*F25J 1/00* (2006.01)

(52) U.S. Cl.
CPC ..... *F25J 1/0022* (2013.01); *F25J 1/005* (2013.01); *F25J 1/0015* (2013.01); *F25J 1/0037* (2013.01);
(Continued)

(58) Field of Classification Search
CPC ..... F25J 1/0022; F25J 1/0015; F25J 1/0072; F25J 1/0202; F25J 1/0204; F25J 1/0234;
(Continued)

(56) References Cited

U.S. PATENT DOCUMENTS 4,638,639 A * 1/1987 Marshall ..... F25J 1/0208 62/613
5,137,558 A * 8/1992 Agrawal ..... F17C 9/04 62/612
(Continued)

FOREIGN PATENT DOCUMENTS

EP 1 435 497 7/2004
WO WO-2014053297 A2 * 4/2014 ..... F25J 1/0037

OTHER PUBLICATIONS

International Written Opinion for PCT/FR2016/052888, dated Mar. 1, 2017 (English machine translation).
(Continued)

*Primary Examiner* — Nelson J Nieves
(74) *Attorney, Agent, or Firm* — Elwood L. Haynes

(57) ABSTRACT

A method for producing liquefied natural gas and a stream of liquid nitrogen including step a): producing gaseous nitrogen in an air separation unit; step b): liquefying a stream of natural gas in a natural gas liquefaction unit including a main heat exchanger and a system for producing cold; step
(Continued)

c): liquefying the nitrogen stream resulting from step a) in the main exchanger of the natural gas liquefaction unit in parallel with the liquefied natural gas in step b); wherein all the cold necessary for liquefying the stream of nitrogen and for liquefying the natural gas is supplied by the system for producing cold of the natural gas liquefaction unit.

3 Claims, 1 Drawing Sheet

(52) U.S. Cl.
CPC ..... *F25J 1/0072* (2013.01); *F25J 1/0202* (2013.01); *F25J 1/0204* (2013.01); *F25J 1/0234* (2013.01); *F25J 1/0236* (2013.01); *F25J 1/0288* (2013.01); *F25J 3/04224* (2013.01); *F25J 3/04278* (2013.01); *F25J 3/04357* (2013.01); *F25J 3/04393* (2013.01); *F25J 3/04412* (2013.01); *F25J 2245/42* (2013.01); *F25J 2270/06* (2013.01); *F25J 2270/16* (2013.01); *F25J 2270/42* (2013.01)

(58) Field of Classification Search
CPC .... F25J 1/0288; F25J 3/04224; F25J 3/04278; F25J 3/04357; F25J 3/04393; F25J 3/04412; F25J 2245/42; F25J 2270/06; F25J 2270/16; F25J 2270/42
See application file for complete search history.

(56) References Cited

U.S. PATENT DOCUMENTS 5,139,547 A * 8/1992 Agrawal ..... F17C 9/04 62/616
5,231,835 A * 8/1993 Beddome ..... F25J 1/0015 62/615
5,802,874 A * 9/1998 Voit ..... F25J 1/0015 62/650
6,006,545 A * 12/1999 Tranier ..... F25J 1/0015 62/615
6,393,867 B1 * 5/2002 Guillard ..... F25J 1/0015 60/39.3
2005/0132746 A1 * 6/2005 Brugerolle ..... F25J 1/0012 62/615
2008/0000266 A1 * 1/2008 Dee ..... F25J 1/0015 62/643
2008/0216512 A1 * 9/2008 Herron ..... F25J 1/0015 62/650
2009/0100863 A1 * 4/2009 Dee ..... F25J 3/04266 62/640
2010/0058805 A1 * 3/2010 Howard ..... F25J 1/0015 62/643
2011/0226008 A1 * 9/2011 Gushanas ..... F25J 1/0015 62/613
2013/0118204 A1 * 5/2013 Higginbotham ..... F25J 1/0015 62/615
2014/0053601 A1 * 2/2014 Davidian ..... F25J 3/0406 62/643
2014/0352353 A1 * 12/2014 Wissolik ..... F25J 1/0022 62/611
2015/0121955 A1 * 5/2015 Davidian ..... F25J 3/04412 62/643
2015/0253075 A1 * 9/2015 Davidian ..... F25J 3/0406 62/643
2016/0109180 A1 * 4/2016 Hirose ..... F25J 1/0015 62/651
2017/0089637 A1 * 3/2017 Wehrman ..... F25J 1/0216
2017/0210997 A1 * 7/2017 Van Leeuwen ..... C10G 5/06
2017/0370639 A1 * 12/2017 Bardon ..... F25J 1/0212

OTHER PUBLICATIONS

International Search Report for PCT/FR2016/052888, dated Mar. 1, 2017.
Written opinion for corresponding PCT/FR2016/052888, dated Mar. 1, 2017.

* cited by examiner

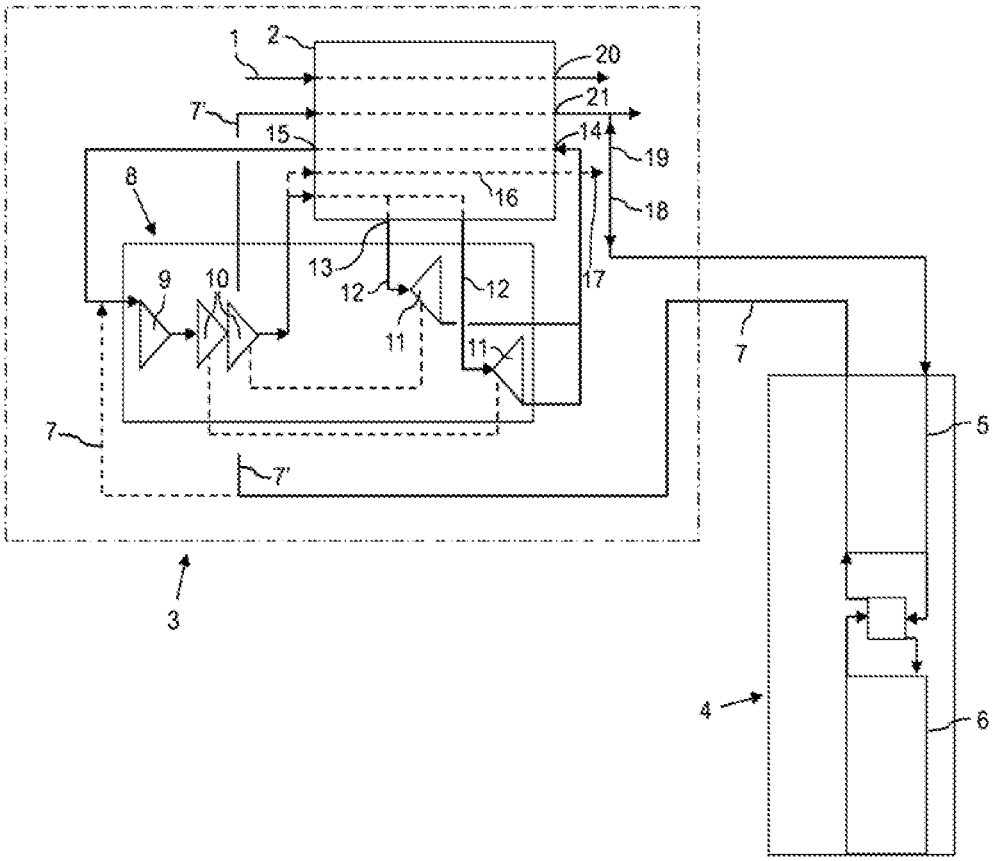
1
2
20
21
7'
15
14
19
8
16
18
13
9
10
12
12
17
11
11
7
7
7'
5
3
4
6

METHOD FOR LIQUEFYING NATURAL GAS AND NITROGEN

CROSS REFERENCE TO RELATED APPLICATIONS

This application is a 371 of International Application PCT/FR2016/052888 filed Nov. 8, 2016, which claims priority to French Patent Application 1561923 filed Dec. 7, 2015, the entire contents of which are incorporated herein by reference.

BACKGROUND

The present invention relates to a method for liquefying a stream of hydrocarbons such as natural gas in particular in a method for producing liquefied natural gas and a stream of liquid nitrogen. At typical plants for liquefaction of natural gas using a mixed refrigerant cascade, refrigerant streams are used for producing cold at different levels of a main heat exchanger by evaporating against the hydrocarbon stream to be liquefied (typically natural gas).

The present invention is particularly suitable at a site where an air separation unit (ASU) and a natural gas liquefaction unit are present.

Liquefaction of natural gas is desirable for a number of reasons. For example, natural gas can be stored and transported over great distances more easily in the liquid state than in gaseous form, as it occupies a smaller volume for a given mass and does not need to be stored at high pressure.

Thermally combining an air separation unit with a natural gas liquefaction unit, in which the cold necessary for liquefaction of natural gas is produced by the air separation unit via liquid nitrogen, is known from the prior art, in particular from patent application EP 1435497.

The drawback of such a system is that in general the amount of liquid nitrogen produced by the air separation unit is not sufficient to avoid the capital expenditure on a system for producing cold (turbo machinery for example) for the natural gas liquefaction unit.

Moreover, liquefaction of natural gas by liquid nitrogen is much less efficient energetically than the use of refrigeration cycles such as the nitrogen cycle, based on the principle of the reverse Brayton cycle, or a cycle using mixed refrigerants, based on the evaporation of different hydrocarbon streams at different levels in the liquefaction exchanger.

SUMMARY

The inventors of the present invention have developed a solution for solving the problem described above, namely to minimize the capital expenditure for a system for producing cold in the air separation unit and therefore to optimize the capital expenditure while maintaining optimum efficiency for liquefaction of natural gas in the liquefaction unit.

The present invention relates to a method for producing liquefied natural gas and a stream of liquid nitrogen comprising at least the following steps:

Step a): producing gaseous nitrogen in an air separation unit (ASU);

Step b): liquefying a stream of natural gas in a natural gas liquefaction unit comprising a main heat exchanger and a system for producing cold;

Step c): liquefying the stream of nitrogen resulting from step a) in said main exchanger of the natural gas liquefaction unit in parallel with the liquefied natural gas in step b);

characterized in that all the cold necessary for liquefying the stream of nitrogen and for liquefying the natural gas is supplied by said system for producing cold of the natural gas liquefaction unit.

According to other embodiments, the invention also relates to:

A method as described above, characterized in that the air separation unit comprises at least one so-called high-pressure column and at least one so-called low-pressure column, the gaseous nitrogen produced in step a) being produced at the top of the low-pressure column.

A method as described above, characterized in that part of the liquefied nitrogen resulting from step c) is recycled to the air separation unit at the level of the top of the low-pressure column.

A method as described above, characterized in that said system for producing cold comprises at least one compressor and at least one turbine-booster system.

A method as described above, characterized in that the liquefaction unit comprises a refrigeration cycle supplied with a refrigerant stream containing at least one of the constituents selected from nitrogen, methane, ethylene, ethane, butane and pentane.

The present invention also relates to a device for producing liquefied natural gas and liquid nitrogen comprising an air separation unit producing at least one gaseous nitrogen stream and a natural gas liquefaction unit, said natural gas liquefaction unit comprising at least one main heat exchanger and a system for producing cold, characterized in that the system for producing cold is suitable for and designed for liquefying both the stream of nitrogen from the air separation unit and the stream of natural gas circulating in the natural gas liquefaction unit.

According to a particular embodiment, the invention relates to a device as described above, characterized in that said system for producing cold comprises at least one compressor and at least one turbine-booster system.

The aim of the present invention is thermal coupling of a unit for liquefying a hydrocarbon-rich gas, typically natural gas, with an air separation unit (ASU).

"Thermal coupling" means combining the means for producing cold to ensure thermal balance of the two units, typically air compressor, refrigeration cycle compressor, and optionally a turbine/booster system.

"Turbine/booster system" means a turbine mechanically coupled (via a common shaft) to a single-stage compressor, the power generated by the turbine being transmitted directly to the single-stage compressor.

As the cold requirement of a natural gas liquefaction unit is generally greater than the cold requirement of an air separation unit, it is relevant to take advantage of the machines (compressors and/or turbine/boosters) of the natural gas liquefaction unit for ensuring at least partially the cold requirement of the air separation unit and notably for limiting capital expenditure on machinery of the ASU.

In particular, the incremental expenditure for increasing the liquefaction capacity of a hydrocarbon liquefier is far lower than the incremental expenditure for increasing the liquid production capacity of an air separation unit.

The invention applies in particular to an air separation unit producing one or more gaseous streams, including at least one stream of gaseous nitrogen.

This stream of gaseous nitrogen is sent to the main exchanger of the natural gas liquefaction unit, where it liquefies in parallel with the stream of natural gas. The cold necessary for the liquefaction of this stream of gaseous nitrogen is supplied by the means for producing cold of the natural gas liquefaction cycle itself, typically the cycle compressor optionally with turbine/boosters.

The stream of gaseous nitrogen may optionally be compressed before being sent to the unit for liquefying the natural gas, to facilitate its liquefaction.

Once liquefied, the nitrogen stream is returned at least partially to the air separation unit, typically to the top of a low-pressure column, to provide the cold balance there.

One of the advantages of this solution is that it takes advantage of the cold capacity of the natural gas liquefier to increase the yield of oxygen and argon of the ASU while limiting the capital expenditure thereon. This solution also makes it possible for an ASU, which in its initial configuration produces almost only gaseous streams and only a small amount of liquids, to produce larger amounts of liquid streams while limiting overinvestment.

In the particular case of a natural gas liquefaction cycle with nitrogen, for which production of cold is provided by a cycle compressor as well as by at least one turbine/booster system, the stream of gaseous nitrogen from the ASU will preferably be introduced upstream of the cycle compressor so as to be compressed there before being liquefied in the main exchanger of the natural gas liquefaction unit.

Although the method according to the present invention is applicable to various hydrocarbon feed streams, it is particularly suitable for streams of natural gas to be liquefied. Furthermore, a person skilled in the art will easily understand that, after liquefaction, the liquefied natural gas may be treated further, if desired. As an example, the liquefied natural gas obtained may be depressurized by means of a Joule-Thomson valve or by means of a turbine.

Furthermore, other intermediate treatment steps may be carried out between gas/liquid separation and cooling. The hydrocarbon stream to be liquefied is generally a stream of natural gas obtained from natural gas fields or oil reservoirs. As an alternative, the stream of natural gas may also be obtained from another source, also including a synthetic source such as a Fischer-Tropsch process.

Usually, the stream of natural gas consists essentially of methane. Preferably, the feed stream comprises at least 60 mol % of methane, preferably at least 80 mol % of methane. Depending on the source, the natural gas may contain quantities of hydrocarbons heavier than methane, such as ethane, propane, butane and pentane as well as certain aromatic hydrocarbons. The stream of natural gas may also contain non-hydrocarbon products such as $H_2O$, $N_2$, $CO_2$, $H_2S$ and other sulfur compounds, etc.

The feed stream containing natural gas may be pretreated before it is fed into the heat exchanger. This pretreatment may comprise reduction and/or removal of undesirable components such as $CO_2$ and $H_2S$, or other steps such as precooling and/or pressurizing. Since these measures are well known by a person skilled in the art, they are not described in more detail here.

The expression "natural gas" as used in the present application refers to any composition containing hydrocarbons including at least methane. This includes a "crude" composition (before any treatment such as cleaning or washing), as well as any composition that has been treated partially, substantially or completely for reduction and/or removal of one or more compounds, including, but not limited to, sulfur, carbon dioxide, water, and hydrocarbons having two or more carbon atoms.

The heat exchanger may be any column, a unit or other arrangement suitable for allowing the passage of a certain number of streams, and thus allowing direct or indirect heat exchange between one or more lines of refrigerant, and one or more feed streams.

BRIEF DESCRIPTION OF THE DRAWING

For a further understanding of the nature and objects for the present invention, reference should be made to the following detailed description, taken in conjunction with the accompanying drawings, in which like elements are given the same or analogous reference numbers and wherein:

The sole FIGURE illustrates the scheme of a particular embodiment of an implementation of a method according to the invention.

DESCRIPTION OF PREFERRED EMBODIMENTS

In the FIGURE, a stream of natural gas 1 is fed into the main exchanger 2 of a natural gas liquefaction unit 3 in order to be liquefied. A stream 20 of liquid natural gas is withdrawn from the liquefaction unit 3. A refrigerant stream circulates in closed cycle in this heat exchanger 2, in order to supply the cold necessary for liquefying said stream 1 of natural gas.

In particular, the present FIGURE describes a liquefaction cycle using nitrogen.

However, other types of natural gas liquefaction cycles may be employed, for example a reverse Brayton cycle (notably supplied with nitrogen, but it is also possible to use the NG cycle itself) or a cycle based on one or more mixed refrigerants.

At the same site, an air separation unit (ASU) 4 containing at least one so-called high-pressure column 6 and a so-called low-pressure column 5 produces a gaseous nitrogen stream 7. This nitrogen stream 7 is fed into the system 8 for producing cold of the liquefaction unit 3 via a compressor 9. At the outlet of the compressor, the nitrogen stream is fed into at least one booster 10 in series with the compressor 9. At least part of the flow from this at least one booster 10 is connected to at least one turbine 11, a turbine 11 connected to a booster 10 forming what is called a turbine/booster system in the present application. At the outlet of the booster 10, the nitrogen stream is fed into the main heat exchanger 2 to be cooled in parallel with the stream 1 of liquefied natural gas in this exchanger 2. A part 12 of the gaseous stream thus cooled is withdrawn from the exchanger 2 at an intermediate level 13 in order to be fed into the turbine 11 connected to the booster 10 from which the gaseous stream previously fed into the exchanger 2 is obtained. At the outlet of the turbine 11, the nitrogen stream is fed back into the heat exchanger 2 at its coldest end (i.e. an inlet 14 whose temperature level is the lowest of the temperature levels of the exchanger 2). The nitrogen stream thus fed into the exchanger is then heated as far as the outlet 15 of the exchanger 2 whose temperature level is the highest, and then is sent to the compressor 9 in order to follow the same path as stream 7.

The other part 16 of the nitrogen stream at the outlet of booster 10 fed into the heat exchanger 2, which is not withdrawn at the intermediate level 13, is liquefied in parallel with the natural gas stream 1. Once liquefied, a stream 17 of liquid nitrogen is split into at least two streams 18 and 19. Stream 18 of liquid nitrogen is recycled to the air separation unit 4 by being fed in at the top of the low-pressure column 5 of unit 4. For its part, the stream of liquid nitrogen 19 is intended for production.

A variant of the method according to the invention consists of feeding at least one part 7' of the stream of gaseous nitrogen 7 withdrawn from the air separation unit 4 directly into the main heat exchanger 2 in order to be liquefied in parallel with the natural gas stream 1 and to be withdrawn in liquid form at an outlet 21 of the exchanger whose temperature level is the lowest and thus rejoin the stream 19 intended for production.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A method for producing liquefied natural gas and a stream of liquid nitrogen, comprising at least the following steps:

Step a): producing gaseous nitrogen in an air separation unit;

Step b): liquefying a stream of natural gas in a natural gas liquefaction unit comprising a main heat exchanger and a refrigeration system;

Step c): liquefying the nitrogen stream resulting from step a) in the main heat exchanger of the natural gas liquefaction unit in parallel with the liquefied natural gas in step b) and exporting at least a portion of the liquefied nitrogen stream as a product;

wherein all the refrigeration necessary for liquefying the stream of nitrogen and for liquefying the natural gas is supplied by said refrigeration system of the natural gas liquefaction unit.

2. The method as claimed in claim 1, wherein said refrigeration system comprises at least one compressor and at least one turbine-booster system.

3. The method as claimed in claim 1, wherein the liquefaction unit comprises a refrigeration cycle supplied with a refrigerant stream comprising at least one constituent, wherein at least one constituent is selected from the group consisting of nitrogen, methane, ethylene, ethane, butane and pentane.

* * * * *